United States Patent [19]

Kaeser

[11] Patent Number: 4,550,718

[45] Date of Patent: Nov. 5, 1985

[54] FACIAL MASSAGE DEVICE

[75] Inventor: Charles Kaeser, Pully, Switzerland

[73] Assignee: P. F. Cosmetique, Paris, France

[21] Appl. No.: 477,334

[22] Filed: Mar. 21, 1983

[30] Foreign Application Priority Data

Mar. 22, 1982 [FR] France ..... 82 4824

[51] Int. Cl.[4] ..... A61H 15/00

[52] U.S. Cl. ..... 128/57; 15/144 A

[58] Field of Search ..... 128/24.3, 24.4, 57, 128/62 R, 67; D24/36; 15/144 A

[56] References Cited

U.S. PATENT DOCUMENTS

| | | | |
|---|---|---|---|
| 1,635,744 | 7/1927 | Duncan . | |
| 1,724,842 | 8/1929 | Kazmazyk | 128/57 X |
| 2,258,931 | 10/1941 | Heer et al. . | |
| 2,633,844 | 4/1953 | Herndon | 128/60 X |
| 3,542,016 | 11/1970 | Zimmer | 128/57 |

FOREIGN PATENT DOCUMENTS

| | | | |
|---|---|---|---|
| 121925 | 11/1926 | Fed. Rep. of Germany | 128/57 |
| 1169036 | 12/1958 | France . | |
| 388531 | 11/1960 | Switzerland | 128/41 |
| 17580 | of 1898 | United Kingdom | 128/57 |
| 205989 | 11/1923 | United Kingdom | 128/57 |

*Primary Examiner*—Richard J. Apley
*Assistant Examiner*—David J. Brown
*Attorney, Agent, or Firm*—Gordon W. Hueschen

[57] ABSTRACT

The present invention relates to a facial massage device comprising a support formed of a handle (11) terminated by a curved section (12) which supports a massage plate (13) in which there are provided a series of openings (15) intended to retain rotary massage balls (14). A central ball (17) is connected by a rod (18) to a ball joint (19) embedded in a socket (20) in the part (12) of the handle (11). The balls (14) protrude extensively from the plate (13) which serves as support for them, and the assembly consisting of the ball and plate (13) is highly movable with respect to the handle (11) due to the double articulation formed by the central ball (17) and the ball joint (19).

16 Claims, 3 Drawing Figures

FACIAL MASSAGE DEVICE

The present invention concerns a facial massage device which comprises a support and at least one rotary massage ball mounted on said support.

Various massage devices are already known which comprise a support and one or more rotary balls housed in recesses in said support.

Ball massage apparatus are described, in particular, in French Pat. Nos. 1 182 894, 1 289 561 and 1 184 759. All of these apparatus have a support of relatively large size, one of whose faces has a number of massage protuberances which, in fact, are rotary balls housed in cells provided in the support.

These devices are generally intended for massaging large areas of the body, i.e., the back and the limbs, but due to their size they do not lend themselves to the massaging of the face, which requires a smaller massaging device of sufficient mobility that it can be applied to all surfaces of the face.

The present invention is directed at filling this gap by providing a device which is specifically adapted to facial massage, is of very small size and is of very great mobility.

For this purpose, the facial massage device of the invention is characterized by the fact that the support is composed of a handle and of a plate advantageously articulated to said handle and by the fact that the plate comprises a multiplicity of circular openings of such a nature that the rotary balls are held within said openings while being capable of turning freely in all directions.

The support has an essentially flat face on the side away from the handle and has a peripheral edge. The balls are mounted in the peripheral edge in such a way that segments thereof protrude beyond the flat face and beyond the peripheral edge. This support can have a second essentially flat face parallel to the first-named face and spaced therefrom, preferably a distance less than about one-half the diameter of a ball, so that segments protrude beyond both flat faces and beyond the peripheral edge.

Another ball can be mounted in the central portion of the support and the balls are advantageously arranged in a geometric pattern in which the space between any two balls is essentially the same as the space between any two others.

The plate is preferably connected to the handle by a ball joint, the ball of which is contained within a suitable socket provided in the handle.

In one preferred embodiment, the facial massage device of the invention comprises a plurality of rotary massage balls contained in corresponding circular openings provided on the periphery of the plate. The plate is advantageously of circular shape and has a central opening within which there is contained a central ball, this ball being connected by a rod to the ball joint in such a manner that the plate is articulated around said central ball and that the assembly consisting of plate and central ball is articulated on the ball joint connected to the handle. Due to this double articulation, the device, and particularly the plate which retains the massage balls, is of very great mobility, which permits the balls to reach all portions of the face and to apply themselves against all surfaces of the face.

In order to facilitate the mounting of the balls on the plate which serves as support for them, the said plate is preferably made of two parts which are symmetrical along a median plane which is parallel to its large faces, each of these parts having a series of circular openings, the side wall of which has a cross section in the shape of a circular arc whose radius is slightly greater than that of the corresponding ball so that when the two symmetrical parts are fastened against each other the balls are held within the cavities defined by the juxtaposition of the corresponding openings provided in the two symmetrical parts of the plate. Furthermore, the balls preferably have a diameter which is at least twice the thickness of the plate so that the balls protrude extensively on both faces of the plate. This arrangement very particularly favors applying the massage device to parts of the face which are particularly difficult to reach.

The present invention will be better understood by reference to the description of an embodiment and the accompanying drawing, in which.

Figure 1:
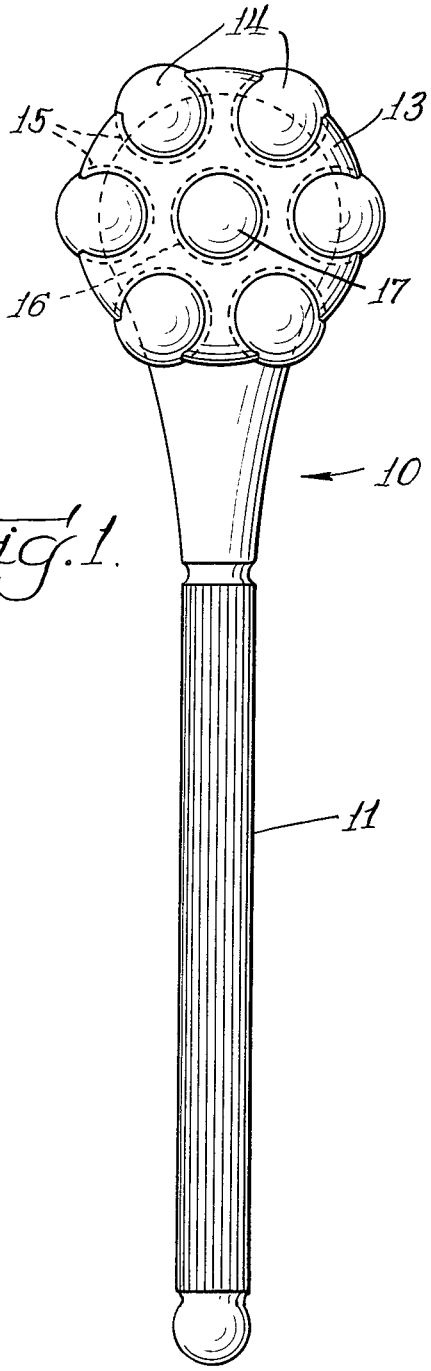
FIG. 1 shows the facial massage device of the invention, seen in bottom view.

Referring to the drawing, the facial massage device 10 of the invention is formed essentially of a handle 11 one of whose ends 12, of slightly curved shape, bears a plate 13 serving as support for an assembly of massage balls 14. The support plate 13 has an assembly of peripheral openings 15 within which the massage balls 14 are arranged and held, as well as a central opening 16 within which there is engaged a central ball 17 around which the plate 13 can turn freely. The central ball 17 is connected by a rod 18 to a ball joint 19 contained within a socket 20 provided in the end piece 12 of the handle 11.

Figure 3:
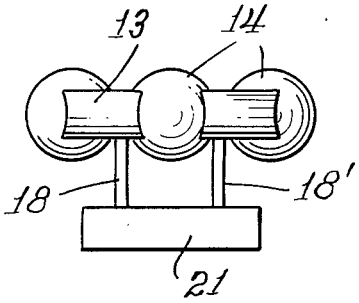
FIG. 3 shows a variant in which the ball joint, which makes it possible to articulate the massage plate to the handle, is formed of a rod which can pivot around its axis.

The articulation of the plate 13 around the end piece 12 can be obtained in a difficult manner, shown in particular in FIG. 3. In accordance with this variant, the plate 13 is connected by two rods 18 and 18' to a cylindrical part 21, intended to be housed within a corresponding recess in the end piece 12. In this case, the assembly consisting of the plate and balls can pivot around the axis of the cylindrical part 21.

The plate 13 is preferably made of two symmetrical parts **13*a* and 13*b*, each having a series of recesses of generally circular shape. In the direction of the thickness of the plate, these recesses have a side wall whose cross section has the shape of a circular arc the radius of which is slightly greater than that of the corresponding ball. In this way, when the two symmetrical parts 13*a* and 13*b*** are assembled, the balls are retained within the circular openings while being capable of turning freely in the resultant cavities.

The balls 14 preferably have a diameter at least equal to twice the thickness of the plate 13. Furthermore, the peripheral openings in the plate open towards the outside so that the balls protrude both on the two faces of the plate and on the edge.

Figure 2:
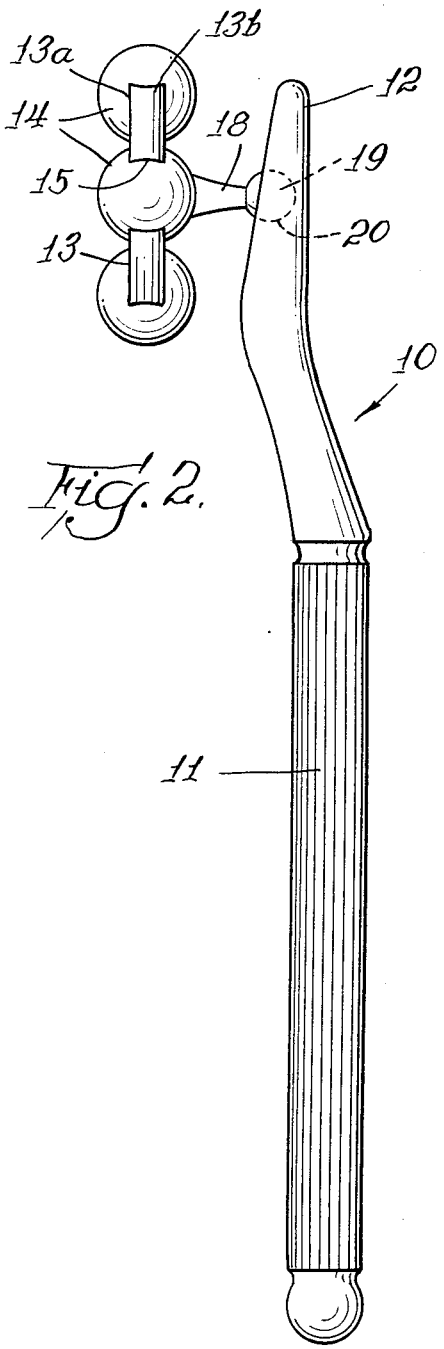
FIG. 2 is a side view in elevation of the device shown in FIG. 1.

As best seen in FIG. 2, the balls are arranged in a geometric pattern in which the space between any two balls is the same as the space between any two other balls. As shown, this space is less than one-half the diameter of the balls. This arrangement provides the necessary space in which the protruding segments of the balls are close enough together to provide a unitary massaging surface composed of individually rotatable units.

The arrangement of the balls on a plate of very small size and the presence of a single articulation (FIG. 3) and of a double articulation (FIG. 2) in order to assure the mobility of the massage plate with respect to the handle, make this device particularly suitable for facial massage and assure it accessibility to all parts of the face.

Of course, the present invention is not limited to the embodiment described and various modifications may be made by the man skilled in the art without thereby going beyond the scope of the invention.

Thus the rods 18 and 18' can be connected not to a cylindrical part with an axis perpendicular to the extension of said rods as shown in FIG. 3, but to a spherical ball joint 19 contained within a corresponding socket provided in the end part 12 of the handle 11.

Similarly, although in the embodiment shown in the drawings the massage balls 14 are supported by the plate 13 in a position such that their centers are coplanar, other arrangements can be contemplated.

Furthermore, the massage balls (14) may have "flat facets." These facets may be obtained by a simple grinding of the ball at various predetermined places which occupy precise positions with respect to each other. This particular embodiment is not shown in the figures. The Applicant has found that such facetted massage balls make it possible to improve the massaging effect.

It is to be understood that the invention is not to be limited to the exact details of construction, operation, or exact materials or embodiments shown and described, as obvious modifications and equivalents will be apparent to one skilled in the art, and the invention is therefore to be limited only by the full scope of the appended claims.

I claim:

1. A facial massage device comprising a support and at least one rotary massage ball mounted on said support, characterized by the fact that the support is composed of a handle (11) and of a plate (13) articulated on said handle, and by the fact that the plate comprises at least one circular opening (15) so arranged that said rotary ball (14) is retained in said opening while being capable of turning freely in all directions around it, characterized by the fact that the plate is connected to the handle by means of ball joint (19) housed in a suitable socket (20) in the handle, and further characterized by the fact that said plate (13) is of circular shape and comprises a circular opening (16) within which a central ball (17) is housed, said ball being connected by at least one rod (18) to the ball joint (19), in such a manner that the plate is articulated around the central ball and that the assembly consisting of the plate and central ball is articulated on the swivel joint which is connected to the handle.

2. A facial massage device comprising a support, a plurality of rotary massage balls mounted on said support, and an articulated handle connected to said support, characterized by the fact that the support comprises a substantially flat plate (13) provided with recesses of spherical shape forming generally circular openings (15) so arranged that each massage ball (14) is held and can turn freely on itself in all directions in said recess, the balls having a diameter greater than the thickness of the plate so that they protrude prominently from both faces of the plate, and by the fact that at least some of the recesses are arranged at the periphery of the plate and open towards the outside so that the corresponding balls housed in said recesses protrude with respect to the edge of the plate.

3. A device according to claim 2, characterized by the fact that the plate is connected to the handle by means of a swivel joint (19) housed in a suitable recess (20) in the handle.

4. A device according to claim 3, characterized by the fact that said plate (13) is of circular shape and comprises a central recess (16) within which a central ball (17) is housed, said central ball being connected by at least one rod (18) to the swivel joint (19), in such a manner that the plate is articulated around the central ball and the assembly comprises of the plate and central ball is articulated on the swivel joint which is connected to the handle.

5. A device according to claim 2, characterized by the fact that the massage balls (14) have a plurality of flattened facets.

6. A device according to claim 5, characterized by the fact that the facets of the massage balls (14) are obtained by grinding.

7. A device according to claim 2, characterized by the fact that the plate (13) is connected to the handle by means of a single-axis articulation (21, FIG. 3).

8. A device according to claim 7, characterized by the fact that the axis of the said articulation (21) is parallel to the plate (13).

9. A device according to any of claims 2, 3, 4, 7, or 8, characterized by the fact that the plate comprises two parts (**13*a* and 13*b*) which are symmetrical along a median plane parallel to its large faces, each of said parts having a series of recesses of spherical shape, the sidewalls of which have a cross section having the shape of a circular arc and radii of which are slightly greater than that of the corresponding ball, so that, when the two symmetrical parts are fastened to each other, the balls are retained within the cavities defined by the juxtaposition of the corresponding recesses provided in the two symmetrical parts of the plate (13**).

10. A device according to claim 9, characterized by the fact that the balls (14) have a diameter which is at least twice the thickness of the plate (13) so that the balls protrude extensively on both faces of the plate.

11. A device according to claim 10, characterized by the fact that the peripheral openings provided in the plate (13) are open toward the outside of said plate so that the balls (14) protrude extensively on the two parallel faces of the plate and on its edge.

12. A massage device comprising a support plate having an essentially flat face and a peripheral edge and a multiplicity of balls, all having the same diameter, having continuous, uninterrupted surfaces, and being mounted for free rotation in all directions in said support plate with segments of all said balls projecting from said flat face to a common plane parallel to and spaced from said flat face and at least some of said balls projecting from said peripheral edge to an imaginary cylindrical surface parallel to and spaced around said peripheral edge, and handle means articulated to said support on a side opposite to said flat face, whereby said segments can be applied to a body surface and rolled thereon for the purpose of massaging the same.

13. A massage device according to claim 12, in which at least one of said balls is not mounted in the peripheral edge of said support but in the center portion thereof.

14. A massage device according to claim 12, in which said support has an essentialy flat face parallel to and spaced from said first named flat face a distance less than one-half the diameter of said balls.

15. A massage device according to claim 12, in which said balls are spaced in a geometrical arrangement in which the space between any two balls is the same as the space between any two other balls.

16. A massage device according to claim 15, in which the space between said balls is less than one-half a ball diameter.

* * * * *

UNITED STATES PATENT AND TRADEMARK OFFICE

CERTIFICATE OF CORRECTION

PATENT NO. : 4,550,718

DATED : November 5, 1985

INVENTOR(S) : Charles Kaeser

It is certified that error appears in the above-identified patent and that said Letters Patent is hereby corrected as shown below:

Title page, [30] Foreign Application Priority Data; "82 4824" should read -- 82 04824 --

Title page, [56] References Cited, FOREIGN PATENT DOCUMENTS, line 1; "Fed. Rep. of Germany" should read -- Switzerland --

Col. 2, line 40; "difficult" should read -- different --
Col. 4, line 14; "comprises of" should read -- comprising --
Col. 4, line 68; "essentialy" should read -- essentially --

Signed and Sealed this

*Eleventh* Day of *February 1986*

[SEAL]

*Attest:*

DONALD J. QUIGG

*Attesting Officer*

*Commissioner of Patents and Trademarks*